US008297456B1

(12) United States Patent
Anderson

(10) Patent No.: US 8,297,456 B1
(45) Date of Patent: Oct. 30, 2012

(54) DRINKABLE STORAGE AND DISPENSING INGREDIENT CAP FOR A LIQUID CONTAINER

(76) Inventor: Michael R. Anderson, Boca Raton, FL (US)

( * ) Notice: Subject to any disclaimer, the term of this patent is extended or adjusted under 35 U.S.C. 154(b) by 399 days.

(21) Appl. No.: 12/649,438

(22) Filed: Dec. 30, 2009

Related U.S. Application Data

(60) Provisional application No. 61/141,682, filed on Dec. 31, 2008.

(51) Int. Cl.
*B65D 51/22* (2006.01)

(52) U.S. Cl. ..... 215/227; 215/257; 215/DIG. 8; 206/222; 220/258.5

(58) Field of Classification Search ..... 206/219, 206/221, 222; 215/227, 249, 257, 297, DIG. 8; 220/258.3, 258.4, 258.5, 278; 222/83.5, 222/519
See application file for complete search history.

(56) References Cited

U.S. PATENT DOCUMENTS 5,370,222 A 12/1994 Steigerwald et al.
6,644,471 B1 * 11/2003 Anderson ..... 206/222
7,503,453 B2 3/2009 Cronin et al.
7,614,513 B2 * 11/2009 Anderson ..... 215/10
7,886,922 B2 * 2/2011 Seelhofer ..... 215/297
7,951,109 B2 * 5/2011 Anderson ..... 604/87
2007/0051689 A1 * 3/2007 Anderson ..... 215/228
2008/0125704 A1 * 5/2008 Anderson ..... 604/87
2008/0202950 A1 * 8/2008 Anderson ..... 206/219
2009/0020494 A1 * 1/2009 Seelhofer ..... 215/252
2009/0308831 A1 * 12/2009 Anderson ..... 215/227
2010/0000960 A1 * 1/2010 Anderson ..... 215/228

* cited by examiner

*Primary Examiner* — Anthony Stashick
*Assistant Examiner* — Ned A Walker
(74) *Attorney, Agent, or Firm* — Malin Haley DiMaggio Bowen & Lhota, P.A.

(57) ABSTRACT

A three piece ingredient dispensing cap attachable a primary container including but not limited to the threaded circular opening of a bottle, said dispensing cap being a storage container or receptacle for sealably containing a liquid and/or dry material and a dispenser for releasing the material when desired into the primary container. The top of the dispensing cap is depressed manually forcing than ingredient storage chamber with like prongs against the bottom of the cap body seal ripping a portion away, dispensing the material. The top includes an opening or nipple valve to allow drinking through the dispensing cap. The present invention allows the use of materials that would discolor, degrade or interact with other substances when added to the contents of the bottle, to remain stable and/or inactive until the time of use.

6 Claims, 8 Drawing Sheets

DRINKABLE STORAGE AND DISPENSING INGREDIENT CAP FOR A LIQUID CONTAINER

BACKGROUND OF THE INVENTION

1. Field of the Invention

This invention relates to a liquid and/or dry ingredient dispensing and ingredient storage cap that is utilized with a bottle, pack, pouch, carton, can or any other liquid (or non-liquid) primary container having a neck opening. The dispensing cap stores liquid and/or dry ingredients which can be rapidly dispensed into the primary container by manual activation when desired and thereafter readily consumed through the dispensing cap by the user. The device may be pre-mounted on the container opening by threads at the factory after the container itself is partially filled with a liquid. The dispensing device is sold prepackaged by itself or on the primary liquid container. A desiccant can be placed inside the storage chamber.

2. Description of the Prior Art

Many foods, drugs, cosmetics, adhesives, polishes, cleansers, dyes and other substances are frequently supplied in liquid, powder or crystal form and do not retain their stability, strength and effectiveness for long after they have been mixed in solution or suspension with a different liquid. This incompatibility after mixing therefore mandates that the product be utilized relatively soon after mixture to prevent loss of effective strength, deterioration, discoloration, interactions and the like. It is also important that admixtures of various ingredients be done under conditions wherein a measured amount of one ingredient is added to a measured amount of the other chemical to insure that proper results are obtained. The process of loss of effectiveness is often termed "shelf life." Once two different chemicals are combined, the process of deterioration often begins.

Another concern involves merchandising of certain products, where it is frequently desirable to supply two companion products to the consumer in a single package. Thus, many products are, by their very nature, required to be used by the consumer shortly after their manufacture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known.

There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

It is known in the art to provide dispensers containing a concentrate of soluble materials to a fixed quantity of solute, usually water, for dispensing. Thus, the prior art teaches containers for beverages wherein the interior of the container is divided into a compartment having a basic ingredient and a compartment which can be ruptured so as to mix, within the container the basic ingredient and some form of modifier, diluent or flavoring. The basic reason for this prior art container is to provide the mixing action at the time of consumption since prior mixing would have adverse effects. The basic ingredient is often not suitable for consumption by itself and requires mixing with a diluent/modifier prior to consumption.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container.

The prior art shows multi-chamber container and cap in U.S. Pat. No. 7,503,453 issued to Cronin et al. on Mar. 17, 2009. The device shown in the '453 patent includes openings in the dispensing end of the storage chamber which once the chamber is pushed, the openings are disposed causing the materials to be released. The overall construction of the device shown in the '453 patent is complex in construction and operation. The present invention overcomes the problem shown by providing a non-complex dispensing cap that allows the user to drink or consume the mixed the contents in the primary container after the dispenser device is activated.

The present invention provides a liquid and/or dry ingredients containing dispensing cap that is attached to the threaded neck or opening of any type liquid container including packs, bags, cans and plastic or glass bottles. With a bottle as an example, the dispensing device may be mounted typically to the threaded neck or opening of a liquid container having a conventional screw off cap, such as a bottle of water. The dispensing device when manually activated includes a dispenser. The ingredients in the storage chamber are completely sealed within the storage chamber body, and remain separated from the liquid in the primary container bottle until the exact moment of usage, which is determined by the consumer by manually dispensing the ingredients (powder or liquid). The dispensing device can be mounted to any type of package or carton having a threaded circular opening. Thus, active ingredients, e.g. activated oxygen, vitamins, herbs, nutrients or other substances having a short activity life (shelf life) when added to a particular liquid can now be safely and sealably stored in a dispensing cap until time for use and can be subsequently added to the desired liquid, thereby ensuring that the shelf life and time of activity of the materials are not jeopardized even though they are housed within the liquid container.

The present invention also offers the advantage that having a conventional threaded opening does not require significant modification of existing liquid containers, packages, cartons, bottle caps or existing bottles. In fact, the invention can be attached onto existing bottles.

SUMMARY OF THE INVENTION

A dispensing device that acts as a primary container cap and includes separate ingredients sealably containing a liquid and/or powder materials. The cap dispenser includes a cylindrical liquid impervious body that is attached to a conventional circular threaded (or non-threaded) neck or spout of a bottle, can, carton, pouch, and the like. The device is comprised of three interlocking members that form a sealed dispensing cap.

The first member is an ingredient storage chamber and is constructed of a cylinder having a bottom open end and a top partially open end having a central contact barrier connected to the top end periphery. The first member is made of a liquid impervious material such as plastic, metal, polypropylene or polyethylene but not limited thereto. Other materials are suitable. However, the first member could also be made of metal, glass or fabric. The bottom end wall of the first member includes a cutting edge around the bottom periphery.

The second dispensing cap member includes a threaded annular cap body having a longitudinal cylinder having an open top end and a sealed closed bottom end. The inside diameter of the cap body is less than the outside diameter of the first member ingredient storage chamber, such that the storage chamber fits inside the cap body cylinder and can be pushed as a plunger. The perimeter defining the bottom open end of the storage chamber cylinder formed by the cylinder wall is irregularly shaped having two or more spaced apart prong like pointed areas. The top end of the storage chamber has a barrier with opening that engages an actuating member for dispensing. The storage chamber may include a desiccant to prevent moisture from reaching the stored ingredients.

The third member of the dispensing cap is a dispensing actuating member which is manually depressed that engages the storage chamber forcing it downwardly, breaking the seal at the bottom of the dispensing cap body cylinder. The actuating member is cylindrical and includes a safety release band that must be broken before the actuating member can be manually depressed downwardly and also includes a dust cover that can be flipped open to allow the user to drink from the primary container after the contents or ingredients of the dispensing cap have been dispensed. The actuating member also includes a flow through passage along with the actual protrusion that acts as the activating member that engages a contact area covering the top portion which is mostly open in a spoke like fashion that is rigidly attached to the top of the ingredient storage chamber. The actuator projection also includes a passageway longitudinally through the entire top portion of the actuating member to allow fluid to flow through both the storage chamber and the actuator member. The actuating member also includes a dust cover that can be manually opened or closed.

In the preferred embodiment of the invention, the storage chamber sealably fits inside the cap body cylinder with a liquid or powder inside. Both the cap body cylinder and the storage chamber are liquid impervious and the storage chamber and the cap body cylinder are joined together at the factory after the ingredients which are to be dispensed are first loaded into the bottom of the storage chamber. The storage chamber is already attached to the actuating member. The ingredients can be liquid or granular or powder like and are placed in the storage chamber at the factory. With the ingredients in place, the cap body cylinder is engaged over the filled storage chamber.

At the time of use, the activating member at the top of the dispenser can be depressed forcing the ingredient storage chamber downwardly manually until the extending prongs and knife like surface along the perimeter of the open end of the storage chamber engage the weakened area around the perimeter of the cap body cylinder sealed base or bottom ripping and tearing away portions of the sealed base or bottom causing the contents (liquid or powder) to be quickly dispensed by gravity into the liquid in the primary container bottle which in this example is water. The different types of chemicals and uses are extensive. Packages for hair coloring, kitchen foods such as steak and marinate or herbs, automotive products and oral tooth care products are a few that may require use of two chemicals that must be separated until actual use.

Once the ingredients are thoroughly mixed with the liquid in the primary container bottle, the user can drink directly from the primary container bottle inasmuch as the liquid will flow out of the bottle through the apertures disposed in the top of the storage chamber and activating member when the dust cover is open.

One of the advantages of the present invention is that it does not require additional thin foil seals at either end. The capsule once it is sealed at the factory is self-contained and can be sold independently and later screwed onto a liquid bottle, pouch, carton, jug, can or the like or having a threaded circular neck or spout that can be added at the factory when the liquid is added to the bottle. The purpose of having a separate container is to extend the shelf lives of the combined ingredients contained within the dispensing device. Many ingredients have a short shelf life once added to a liquid such as water or other drink. By having the individual dispensing device that are completely sealed until the time of use, the active ingredients can be kept separate from the main ingredient such as the liquid in the bottle, carton, package or container.

In an alternate embodiment of the invention, the cap body cylinder (sealed) closed end could be modified to have a center hole sealed by a removable foil having adhesive.

In another alternate embodiment of the invention, the dispensing cap could have a dust cover that prevents activation of the plunger and that must be removed for use. In addition the plunger top would have a removable plug that covers the hole that would allow the contents in the primary container once mixed with the ingredients after actuation to be consumed from the primary container through the pore hole in the very top of the plunger. The plunger top could also include a nipple closure valve that allows liquid to be consumed from the primary container in a push-pull nipple mounted on the very top of the plunger that has a open position for drinking and a closed position in which fluid would not flow through the top opening based on conventional water bottle nipple valve technology.

It is an object of the invention to provide a threadable or plug cap ingredient dispenser that includes active ingredients that can be readily dispensed into any type of container housing a second material at a desired time, thus not interfering with the shelf life or physical/chemical integrity of the ingredients to be combined.

It is an object of this invention to provide a liquid and/or dry ingredient bearing receptacle that includes a container cap and dispenser to allow consumers to dispense the liquid or powder into the liquid bearing container, pouch, package, carton at any time.

Still another object of this invention is to provide for sanitary release of the desired ingredients from a container cap and dispenser of any size or shape into a liquid-containing package at a time selected by the consumer.

In accordance with these and other objects which will become apparent hereinafter, the instant invention will now be described with particular reference to the accompanying drawings.

DETAILED DESCRIPTION OF THE INVENTION

Figure 1:
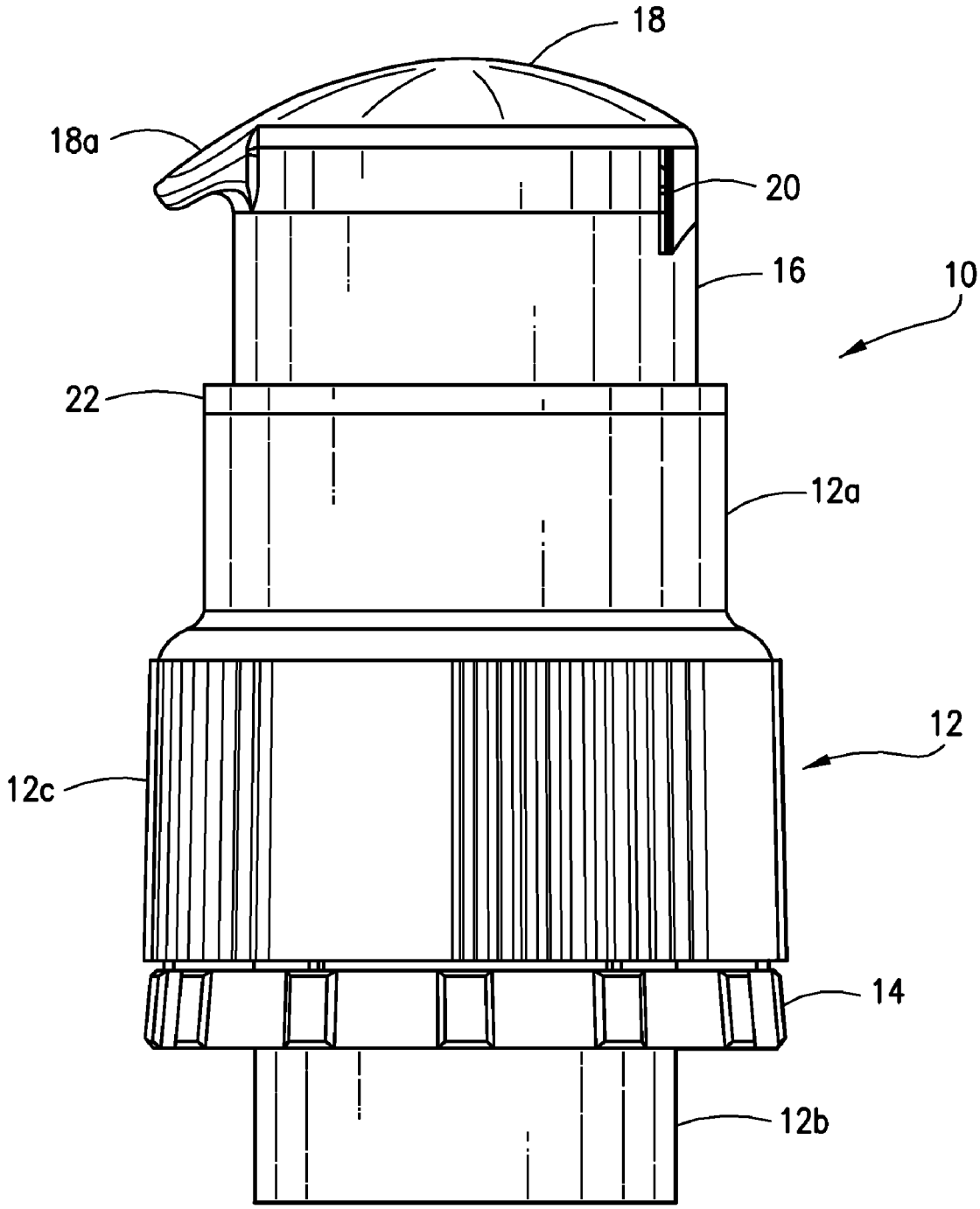
FIG. 1 shows an elevational view of the present invention.

Referring now to the drawings and in particular FIG. 1, the present invention is shown in FIG. 1 at 10 comprised of a water impervious container cap body 12 having an internal cylinder 12*b*. Cylinder 12*b* has a sealed bottom that is integrally formed with the cylinder 12*b* that also includes a weakened line for ease of rupture. A safety retainer ring 14 for the cap body 12 is annularly connected around the base of cap body 12. The interior of cap body 12 includes the longitudinal cylinder 12*b* or sleeve open at the top and sealed at the bottom. A dispenser actuator 16 is connected at the top of cap body 12. A dust cover 18 is connected to the actuator 16 by plastic segment 20.

Figure 2:
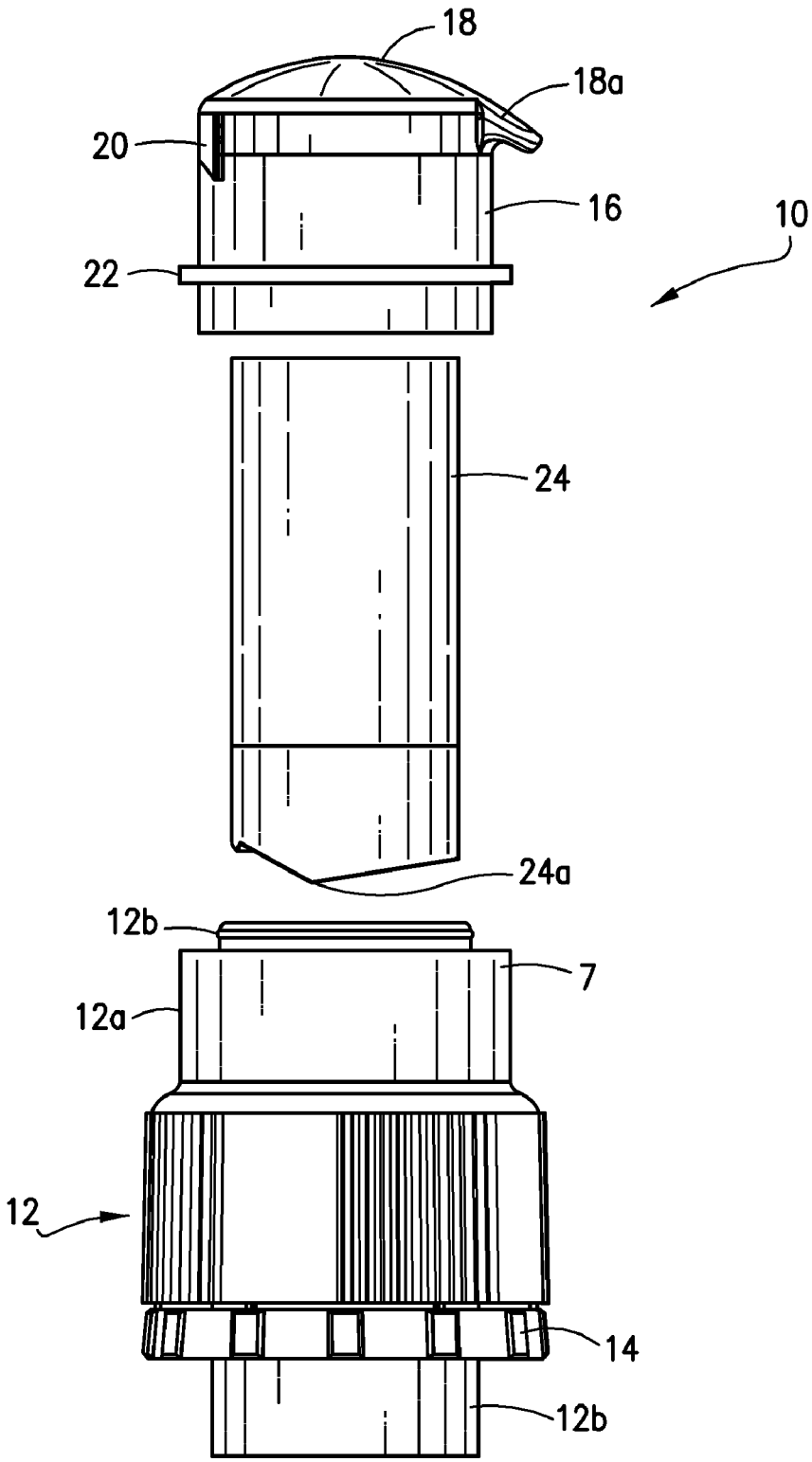
FIG. 2 shows an exploded view of the present invention.

Referring now to FIG. 2 the dispensing cap is shown in an exploded view. FIG. 2 shows all three primary elements of the dispensing cap including the cap body 12, the ingredient storage chamber 24, and the actuator 16 for actuating the dispensing device.

The cap body 12 includes an outer corrugated surface for gripping purposes for twisting the cap body 12 on or off of a conventional container opening such as a bottle neck having threads. The inside annular surface of the cap body includes threads that are used to attach the cap to a container. The cap body also includes a hollow cylinder 12*b* that extends from the bottom to the top longitudinally that receives ingredients storage chamber 24 in a snug but movable fashion. The cap body 12 also includes a second annular wall 12*a* that surrounds the cylinder 12*b* coaxially and provides a slot between the outer wall upper portion of cylinder 12*b* and the inner angular wall of wall 12*a* that receives a portion of the cylindrical body forming the actuator 16. The actuator 16 also includes a release ring 22 that can be broken when depressing actuator 16 downwardly to permit dispensing. Ring 22 is a safety ring to prevent accidental dispensing of the material located in ingredient storage chamber 24. The top opening of actuator 16 includes a dust cover 18 that can be flipped open with flange 18*a* which is connected to the actuator housing 16 by a plastic strand 20 that is flexible and allows the dust cover to be moved between open and closed. The bottom edge of the ingredient storage chamber 24 includes pointed edges or a cutting edge peripherally that is used to tear and rip apart a sealed member affixed to the bottom of cylinder 12*b* sealing the materials in until dispensing time.

Figure 3:
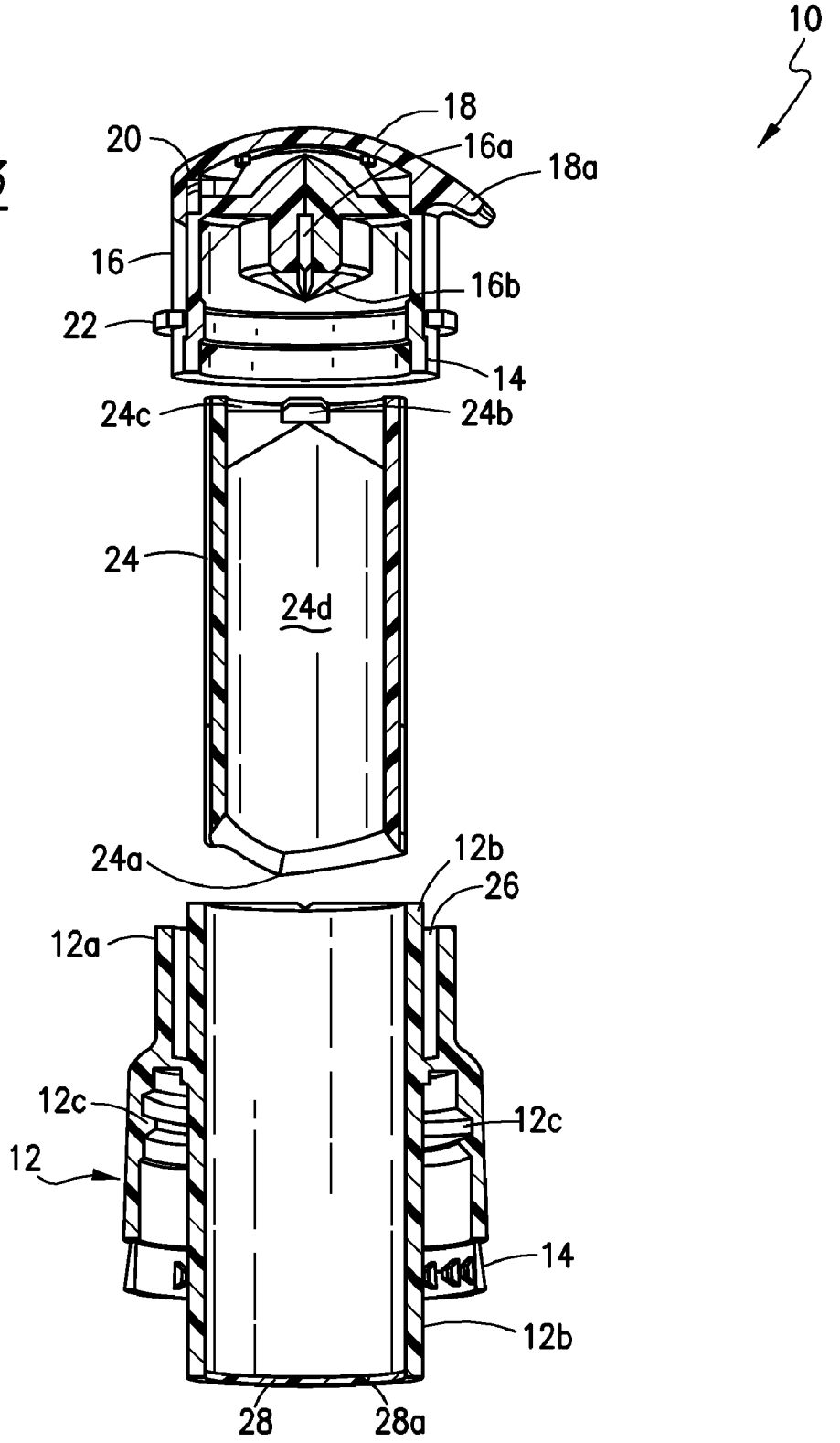
FIG. 3 shows an exploded view in cross section of the present invention.

Referring now to FIG. 3 the device is shown in an exploded view in cross section. Note that the cap body 12 has internal threads 12*c* in an annular rigid molded body that is directly integrated with cylinder 12*b*. The cap threads 12*c* are used for screwing the cap body 12 onto or off of a liquid container threaded spout opening that includes comparable threads for fastening a cap body 12 to a primary container or bottle opening. The cylinder 12*b* in cap body 12 also include a sealed end cover 28 which may be molded as part of the entire cap body 12 and may includes a line of weakening 28*a* which permits the ingredient storage chamber base 24*a* when pushed downwardly to rip through the seal cover 28 causing any material in ingredient storage chamber 24*d* to be dispensed into the primary container once the seal 28 is ripped away. Also note that the top of the opening for ingredient storage chamber 24 includes a rigid bar 24*c* that acts like a support spoke with three or four rigid bars that affix a contact area 24*b* in the center of the coaxial axis of ingredient storage chamber 24. This is acted upon by a protrusion 16*b* which has rigid spokes disposed radially around the center axis of actuator 16 including flow through chambers 16*a* in a central opening at the top of 16 that allows liquid to flow through when the dust cover is removed so that someone can drink out of the primary container once the ingredients have been dispensed into the primary container after the actuator 16 has been pushed downwardly forcing the ingredient storage chamber 24 downwardly piercing the seal 28. However, the actuator 16 can not be pushed downwardly without overcoming the safety ring 22 which is broken away from the exterior of actuator 16 by a sufficient downward manual force to allow the dispensing action to be accomplished. Note that the annular wall body of actuator 16 is mounted in slot 26 between the cap body cylindrical ring wall 12*a* and the cylinder body 12*b* both of which are coaxial.

Figure 4:
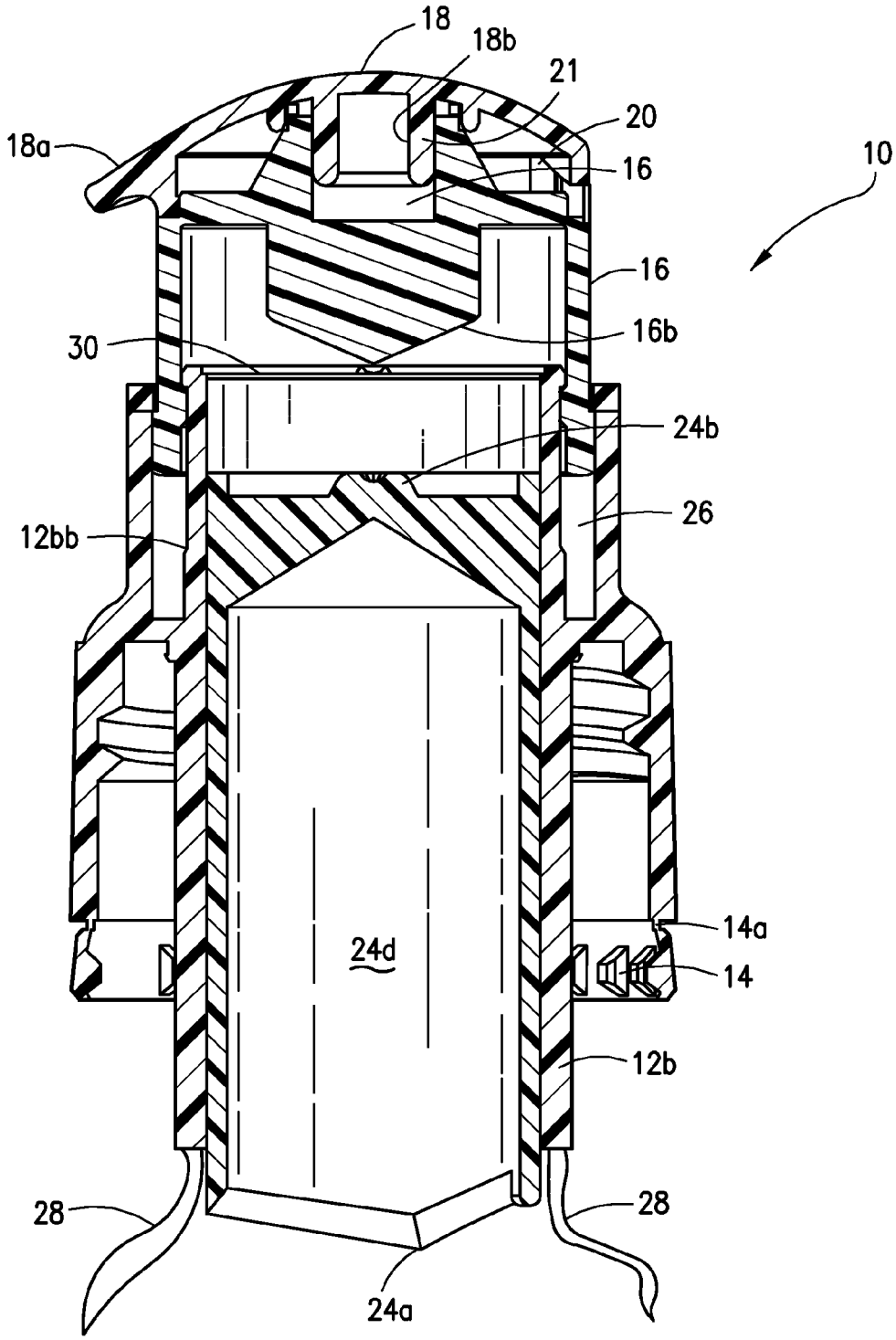
FIG. 4 shows an elevational view in cross section after activation and dispensing of the ingredients in the cap of the present invention.

Referring now to FIG. 4 the upper spout in actuator 16 is shown in which the dust cover actually fits into the upper nipple in the closed position as shown in FIG. 4. Protrusion 16*b* is shown as a solid member but is in fact one of four spokes that radially define the projection when in fact the upper portion has openings to allow liquid to flow there through. Note as shown in FIG. 4 the seal barrier 28 has been broken or torn away from the base of cylinder 12*b* by the cutting surface 24*a* allowing the chamber 24*d* to dispense the ingredients in chamber 24*d* after the actuator 16 was depressed downwardly into a primary container. During actuation, the dispensing mechanism protrusion 16*b* engages the central area 24*b* during the actual dispensing in the downward motion of actuator 16. As shown in FIG. 4, the actuator has been raised back to the full up position after the materials were dispensed.

Figure 5:
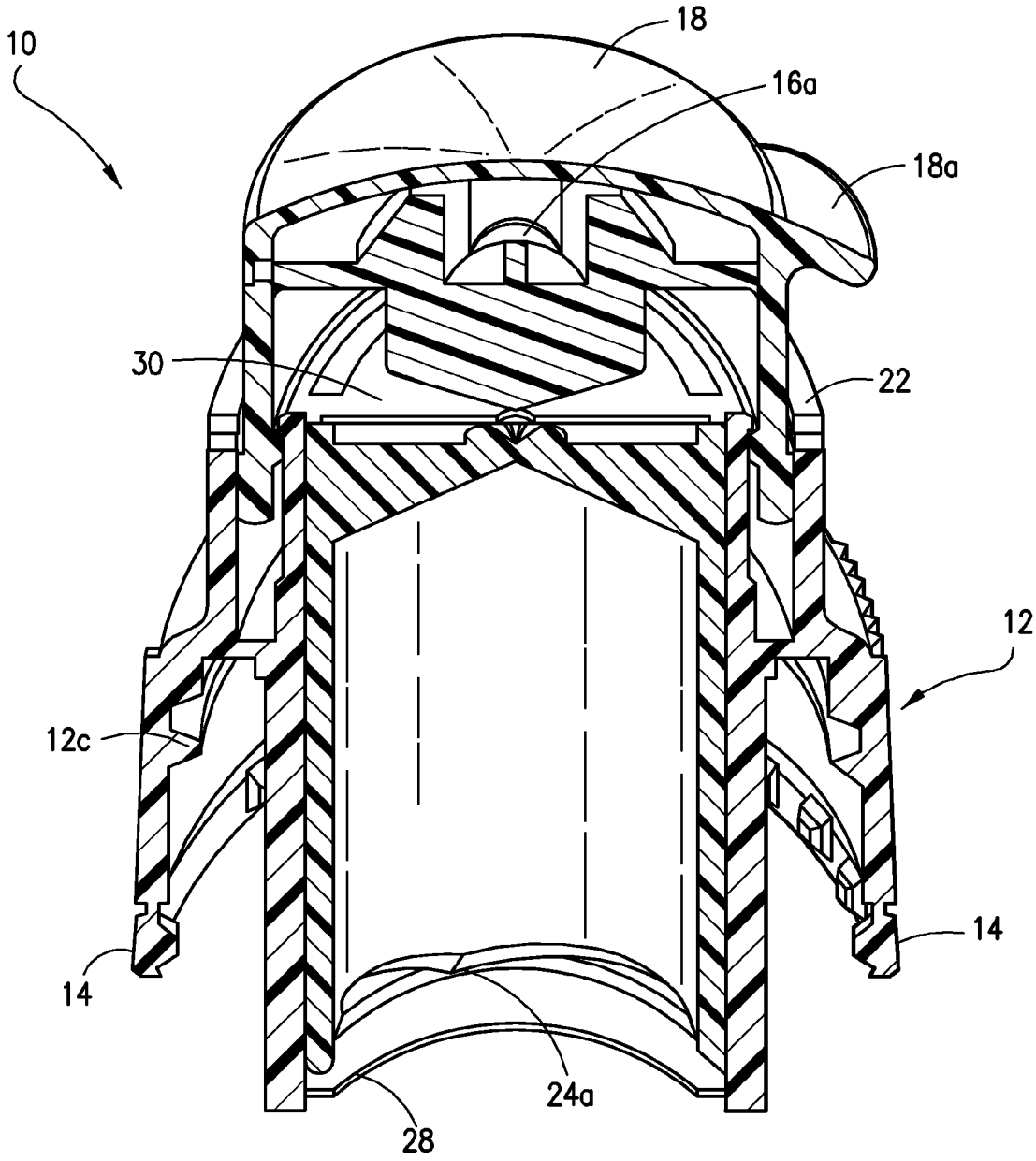
FIG. 5 is a top perspective view in cross section of the present invention.

Referring now to FIG. 5 the dust cover is shown in the closed position but could be lifted by tab 18*a* exposing the top of the actuator at 16*a* to allow liquid to flow through from the primary container so that the user can drink directly from the cap body after actuation.

The safety ring 14 prevents the entire dispensing cap from being removed from a primary container which requires that the safety ring 14*b* be ruptured and separated in order for the entire cap body and dispenser to be removed from the primary container.

In terms of using the device, the entire cap body is mounted on a primary container such as a plastic water bottle containing water. The threads 12*c* are engaged to the neck in circular opening of a conventional plastic water bottle which also has threads and locked in place by the safety lock 14. At the time of use the user would manually push down on the very top of the device including the dust cover causing the actuating body 16 to be moved downwardly breaking safety seal 22. Once that action is commenced the downward continued movement forces the storage chamber 24 downwardly in which the bottom cutting edge of the storage chamber 24 tears away the ingredient seal cover 28 at the bottom of cylinder 12*b* resulting in the ingredients in chamber 24*d* being dispensed into the primary container. The user can then flip open the dust cover 18 and begin drinking the mixed ingredients with the water when desired.

Figure 6:
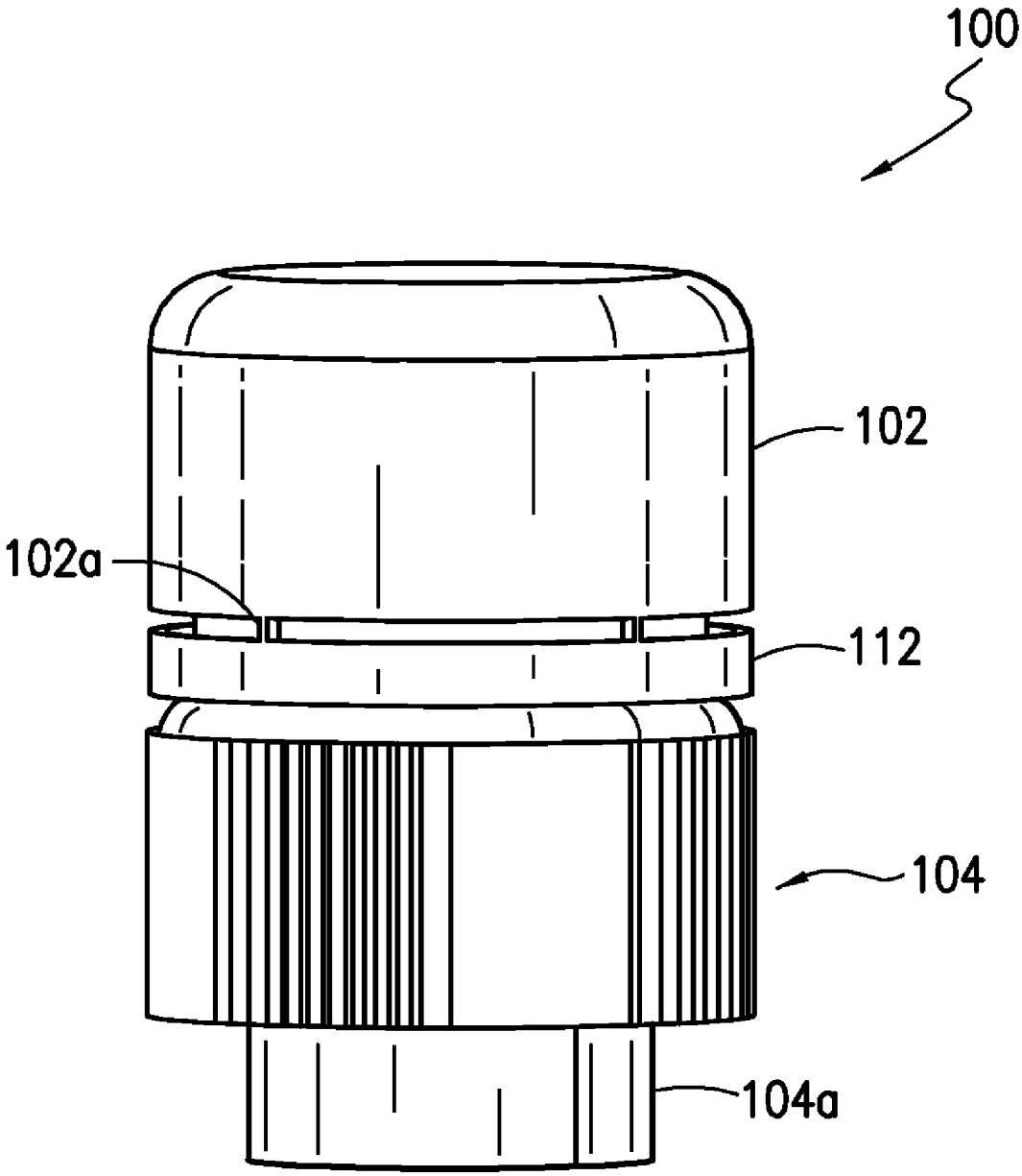
FIG. 6 shows a side elevational view of an alternate embodiment of the present invention.
Figure 7:
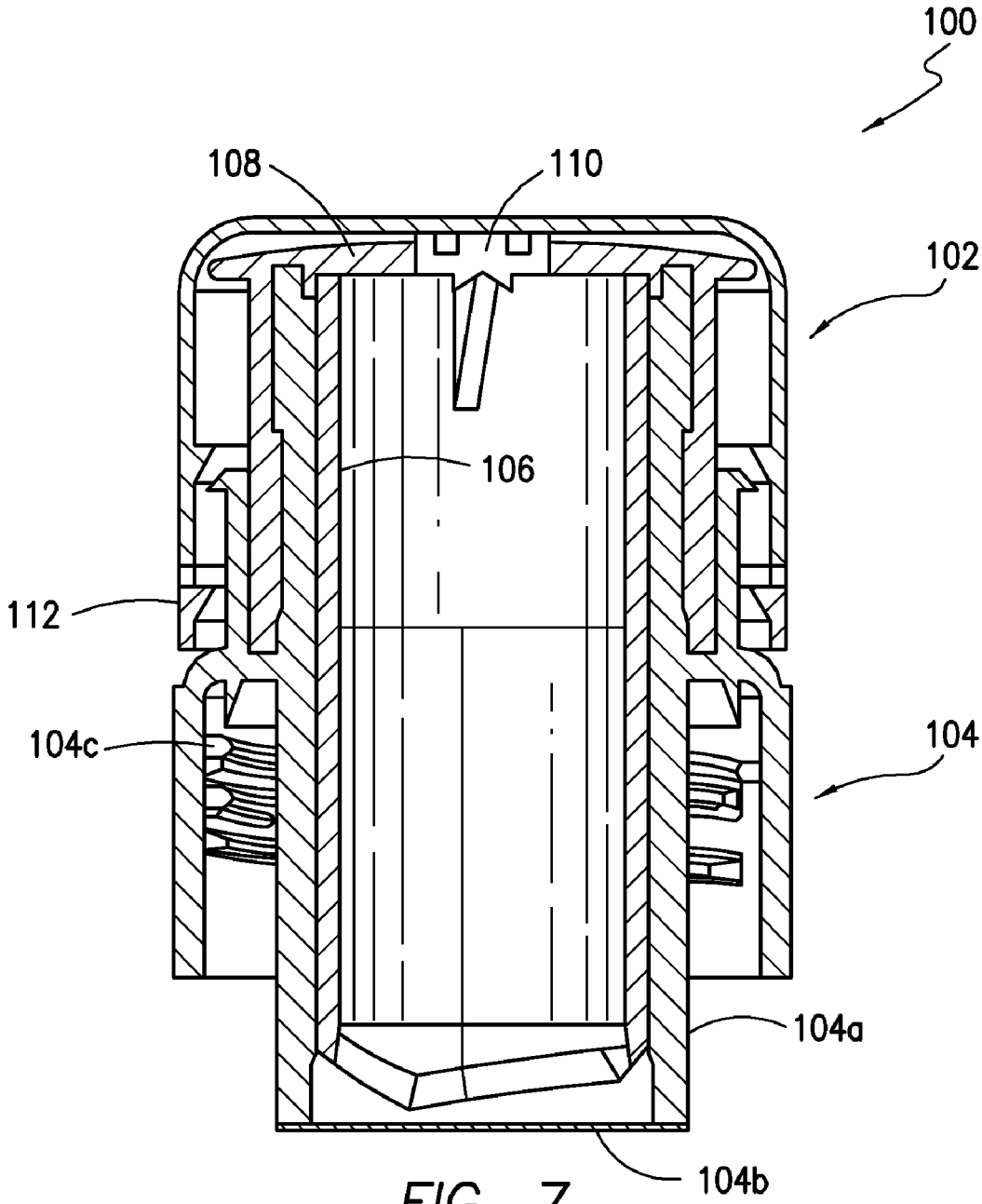
FIG. 7 shows an elevational view in cross-section of the alternate embodiment of the invention shown in FIG. 6.

Referring now to FIGS. 6 and 7, an alternate embodiment of the invention is shown. A dispensing cap 100 includes a dust cover 102 attached by a breakaway 102*a* to a cap body 104 having a lower cylindrical portion 104*a*. Once the dust cover 102 is removed by destroying the breakaway 102*a*, the plunger actuator top 108 is shown in FIG. 7 having a snap out plug 110 that allows fluid to flow through plunger top 108 after the device has been actuated. A plunger 106 is activated by depressing the plunger activator top 108 downwardly breaking seal 104*b* attached to the bottom of cylinder 104*a* which is formed with the cap body 104. The cap body 104 has threads 104*c* that can be attached to a threaded neck of the primary container. The cap body 104 could also be used with a plug that allows the body to be attached to a primary container without threads.

Figure 8:
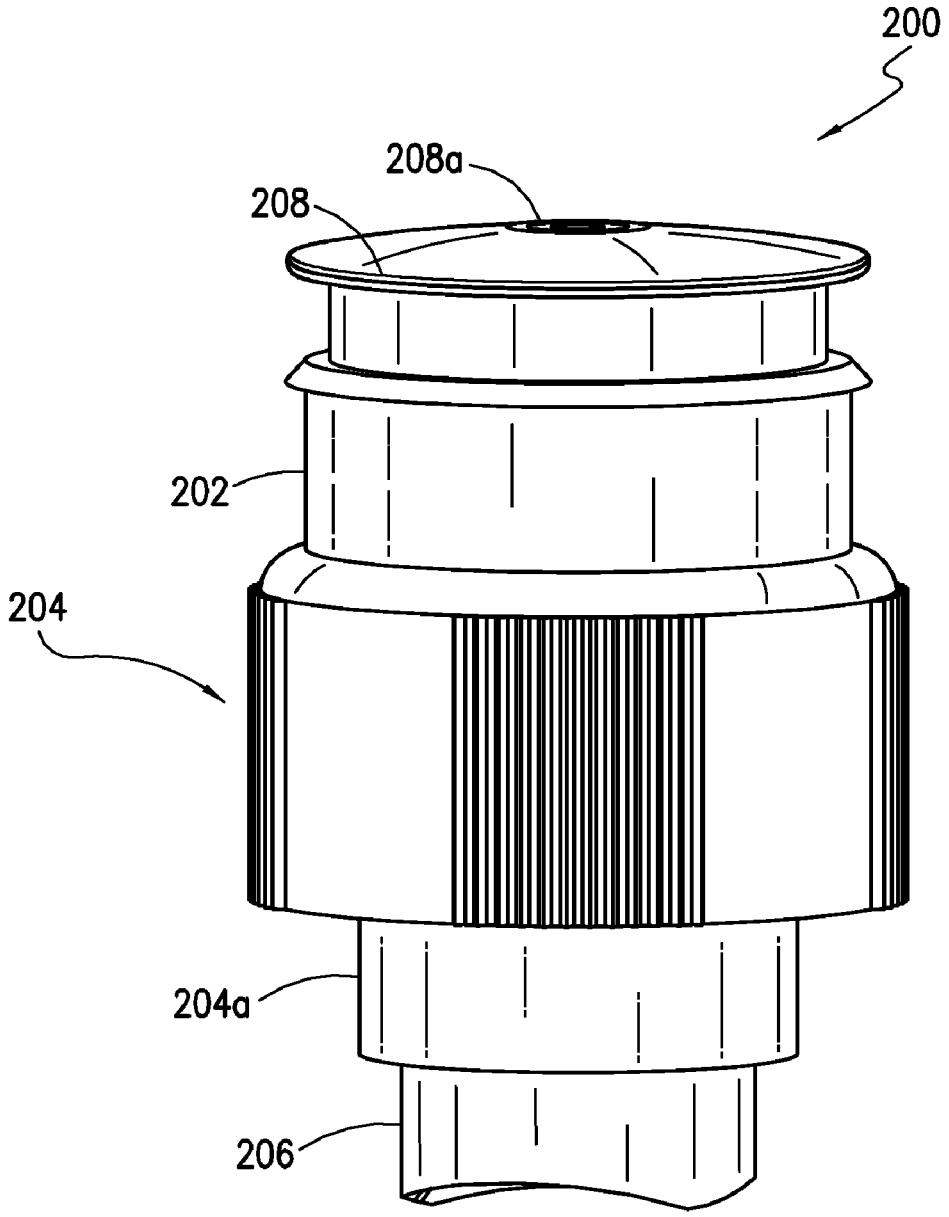
FIG. 8 shows a side elevational view of yet another alternate embodiment of the invention without the dust cover.

Referring now to FIG. 8, another alternate embodiment 200 of the invention is shown. In this embodiment the plunger top 208 has an aperture 208*a* for drinking which serves as a nipple valve 208 that you can pull up for drinking through aperture 208*a* or push down to close. In order to use the nipple valve 208, the dispensing cap 200 must be actuated first by depressing the actuator 202. The cap body 204 and cap body 204*a* house plunger 206 which is activated by the plunger activator 202 as described in the previous embodiments.

The instant invention has been shown and described herein in what is considered to be the most practical and preferred embodiment. It is recognized, however, that departures may be made there from within the scope of the invention and that obvious modifications will occur to a person skilled in the art.

What is claimed is:

1. A dispensing cap for storing and dispensing a separate ingredient, said cap being attachable to a primary liquid container such as a water bottle, said dispensing cap comprising:

a cap body that is impervious to liquids that includes:

a first annular wall having fastening threads disposed on an inside of said first annular wall, a cylindrical sleeve having top and base openings, said sleeve coaxially mounted inside said first annular wall and extending upwardly and downwardly beyond an upper edge and a base of said first annular wall, respectively, said base of said cylindrical sleeve comprising a sealed membrane with a line of weakness covering said cylindrical sleeve base opening, and a second annular wall coaxially surrounding a portion of said cylindrical sleeve and connected at a lower end to said first annular wall and open at an upper end, said cylindrical sleeve top opening extending beyond said second annular wall and spaced by a slot between a portion of said cylindrical sleeve and said second annular wall;

a cylindrical ingredient storage chamber having an outside diameter smaller than an inside diameter of said cylindrical sleeve of said cap body and sized to fit moveably inside said cylindrical sleeve of said cap body, said ingredient storage chamber including an open bottom end that includes a peripheral cutting edge and a top opening that includes a central contact area and a plurality of spoke members connecting said central contact area to the upper edge of said first annular wall;

a dispensing actuator cylindrically shaped and sized to fit in said slot coaxially between said cylindrical sleeve and said second annular wall of said cap body and moveable between a first position and a second position, said dispensing actuator including a centrally downwardly facing protrusion;

wherein said dispensing actuator in the first position is spaced away from said central contact area of said ingredient storage chamber, and wherein said dispensing actuator in the second position is depressed downwardly and engages said ingredient storage chamber, thereby forcing the ingredient storage chamber downwardly to extend partially beyond the cylindrical sleeve base opening and causing said peripheral cutting edge of said ingredient storage chamber to tear said sealed membrane along said line of weakness.

2. The dispensing cap of claim 1, including:

a circular dust cover connected to a top of said dispensing actuator, said circular dust cover exposing the top of said dispensing actuator in an open position, and said circular dust cover sealing the top of said dispensing actuator in a closed position; said dispensing actuator including a liquid passage which allows liquid to be passed through the primary liquid container and through the dispensing actuator to a user.

3. The dispensing cap of of claim 1, wherein:

said dispensing actuator includes a safety ring frangibly connected to and surrounding an exterior of said actuator and positioned to prevent depressed downward movement of said dispensing actuator until said safety ring is broken away by downward force.

4. The dispensing cap of claim 1, wherein:

said cap body includes a safety ring frangibly attached to said first annular wall that includes a cap locking member for preventing said cap body from being removed from a said primary liquid container without breaking said safety ring from said first annular wall.

5. The dispensing cap of claim 1, said cap body further comprising:

a nipple valve for drinking, said nipple valve operable by pushing down to close said nipple valve and pulling up to open said nipple valve.

6. The dispensing cap of claim 1, including:

a desiccant pad housed in said cap body to eliminate moisture.

* * * * *